US010974245B2

(12) United States Patent
Peltosaari et al.

(10) Patent No.: US 10,974,245 B2
(45) Date of Patent: Apr. 13, 2021

(54) SAMPLE VESSEL

(71) Applicant: THERMO FISHER SCIENTIFIC OY, Vantaa (FI)

(72) Inventors: Lauri Peltosaari, Espoo (FI); Joni Rannisto, Kerava (FI)

(73) Assignee: Thermo Fisher Scientific OY, Vantaa (FI)

( * ) Notice: Subject to any disclaimer, the term of this patent is extended or adjusted under 35 U.S.C. 154(b) by 267 days.

(21) Appl. No.: 15/551,937

(22) PCT Filed: Feb. 19, 2016

(86) PCT No.: PCT/FI2016/050104
§ 371 (c)(1),
(2) Date: Aug. 18, 2017

(87) PCT Pub. No.: WO2016/132018
PCT Pub. Date: Aug. 25, 2016

(65) Prior Publication Data

US 2018/0071729 A1 Mar. 15, 2018

(30) Foreign Application Priority Data

Feb. 19, 2015 (FI) ..... 20155107

(51) Int. Cl.
*B01L 3/00* (2006.01)
*B65D 47/00* (2006.01)
(Continued)

(52) U.S. Cl.
CPC ..... *B01L 3/508* (2013.01); *B01L 3/5082* (2013.01); *B65D 41/185* (2013.01); *B65D 47/00* (2013.01);
(Continued)

(58) Field of Classification Search
None
See application file for complete search history.

(56) References Cited

U.S. PATENT DOCUMENTS 4,755,356 A 7/1988 Robbins et al.
5,295,599 A 3/1994 Smith
(Continued)

FOREIGN PATENT DOCUMENTS

CA 2177974 C 9/2005
CN 201978760 9/2011
(Continued)

OTHER PUBLICATIONS

FI, Office Action of the Finnish Patent and Registration Office, Finnish Patent Application No. 20155107, 4 pages, dated Apr. 23, 2018.
(Continued)

*Primary Examiner* — Neil N Turk

(57) ABSTRACT

A sample vessel (1, 11) for transferring and analyzing a sample with analyzer instrument, which sample vessel comprises an elongated vessel body (2, 12) for containing the sample and a hinged cap (3, 13) connected in top end area of the vessel body, and the cross-section of the vessel body (2, 12) on a transversal plane in relation to the lengthwise center axis of the vessel body the inner surface of the vessel body is rotationally asymmetrical in relation to the lengthwise center axis, wherein the sample vessel (1, 11) comprises a surface (5, 15) extending upwards from the vessel body, which surface partially surrounds the edge of the cap (3, 13), when the cap is in closed position.

6 Claims, 3 Drawing Sheets

Figure 1A:
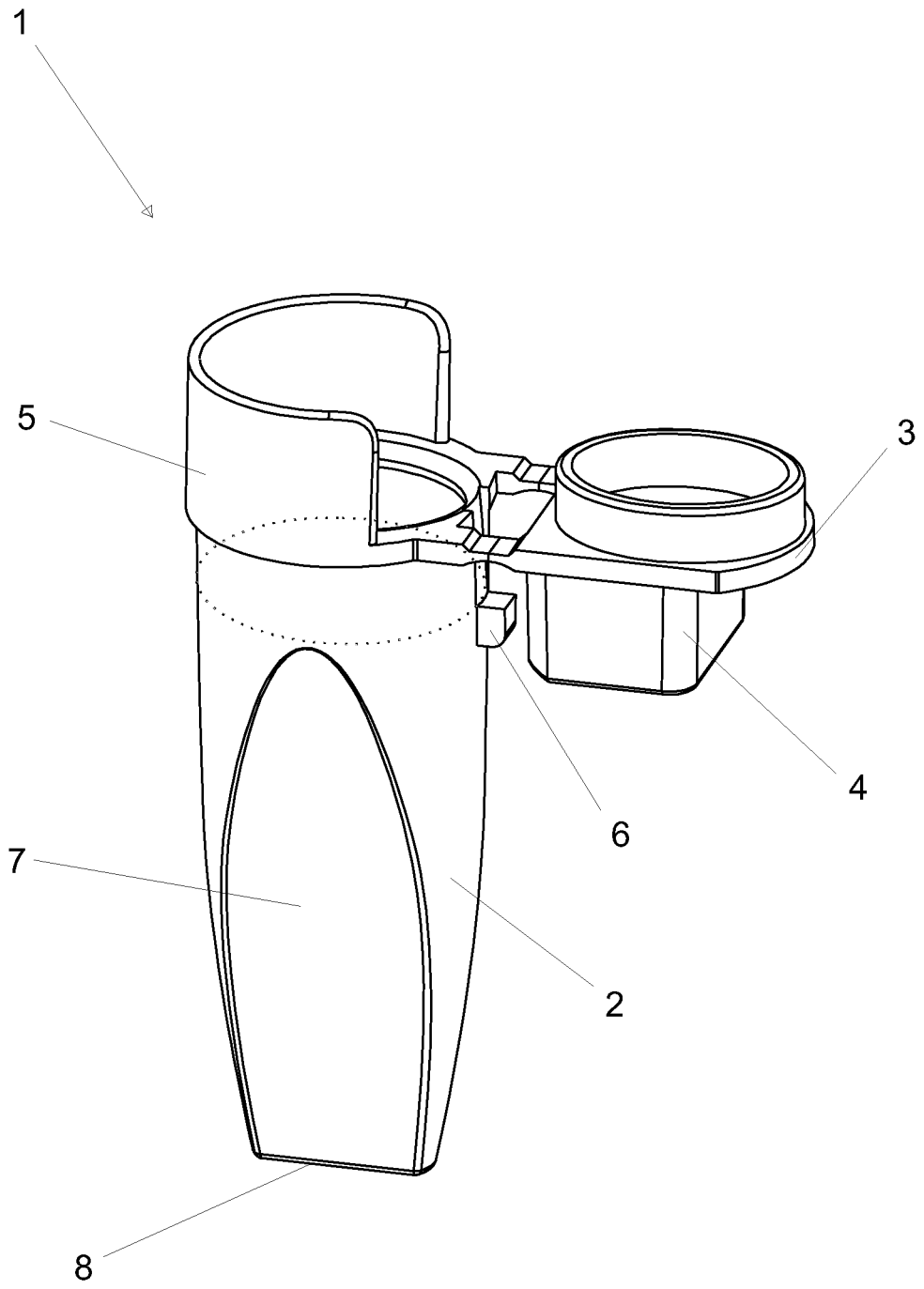

(51) Int. Cl.
*B65D 41/18* (2006.01)
*B65D 47/08* (2006.01)
*B65D 47/40* (2006.01)

(52) U.S. Cl.
CPC ..... *B65D 47/0842* (2013.01); *B65D 47/40* (2013.01); *B01L 3/50825* (2013.01); *B01L 2200/025* (2013.01); *B01L 2200/14* (2013.01); *B01L 2300/021* (2013.01); *B01L 2300/042* (2013.01); *B01L 2300/043* (2013.01); *B01L 2300/0858* (2013.01)

(56) References Cited

U.S. PATENT DOCUMENTS

| | | | | |
|---|---|---|---|---|
| 5,513,768 | A * | 5/1996 | Smith | B01L 3/50825 215/278 |
| 5,862,934 | A | 1/1999 | Sattler et al. | |
| 6,145,688 | A * | 11/2000 | Smith | B01L 3/50825 215/278 |
| 2004/0005246 | A1 * | 1/2004 | Efthimiadis | A61B 10/0051 422/534 |
| 2004/0184965 | A1 | 9/2004 | Smith | |
| 2006/0024205 | A1 | 2/2006 | Giusti | |
| 2008/0228163 | A1 | 9/2008 | Smith | |
| 2010/0084402 | A1 | 4/2010 | Chang | |
| 2012/0269703 | A1 | 10/2012 | Viljoen et al. | |
| 2012/0298665 | A1 | 11/2012 | Foucault | |
| 2013/0209333 | A1 | 8/2013 | Nuotio et al. | |
| 2014/0056784 | A1 | 2/2014 | Simons et al. | |

FOREIGN PATENT DOCUMENTS

| | | | |
|---|---|---|---|
| CN | 104040353 | | 9/2014 |
| WO | 95/17253 | A1 | 6/1995 |
| WO | 2012/056116 | A1 | 5/2012 |
| WO | 2012/058632 | A1 | 5/2012 |
| WO | 2014/135613 | A1 | 9/2014 |

OTHER PUBLICATIONS

CN, Search Report, Chinese Patent Application No. 201680010543.9, 3 pages, dated Mar. 21, 2019.

FI, Search Report of the Finnish Patent and Registration Office, Finnish Patent Application No. 20155107, 2 pages, dated Sep. 17, 2015.

FI, Office Action of the Finnish Patent and Registration Office, Finnish Patent Application No. 20155107, 4 pages, dated Jan. 20, 2017.

PCT, International Search Report and the Written Opinion of the International Searching Authority (European Patent Office), International Application No. PCT/F12016/050104, 11 pages, dated May 9, 2016.

* cited by examiner

SAMPLE VESSEL

CROSS-REFERENCE TO RELATED APPLICATIONS

This application is a National Stage filing of International Application No. PCT/FI2016/050104, filed Feb. 19, 2016, which claims priority of Finnish Patent Application No. 20155107, filed Feb. 19, 2015, which are incorporated herein by reference in their entireties.

FIELD OF TECHNOLOGY

The present invention relates to a sample vessel used to transfer samples, such as biological samples, into suitable analyzer instruments and for storing the samples during analysis process.

TECHNOLOGICAL BACKGROUND

Different kinds of sample vessels, vials and tubes are used for containing samples to be analyzed with analyzer equipment. These samples vessels may contain separate or hinged caps for closing the vessel, and are generally made from plastic or glass. Examples include Thermo Scientific™ Capitol Vial product family.

Other examples of known plastic sample vessels used widely in laboratory work include so-called microcentrifuge tubes, for example from Eppendorf, and various PCR (Polymerase Chain Reaction) reaction tubes.

These kinds of sample vessels are disposable in order to prevent possible sample contamination and other problems related to reusable sample vessels in sample handling and analyzing processes. However, the similarity of these kinds of sample vessels makes them easily mixable, since they are usually identical except for markings identifying the sample, e.g. a hand written or printed label or a barcode requiring machine reading and interpretation, which may cause human derived errors for the analyzing processes.

Known sample vessels also include sample vessels compatible with laboratory automation means and robotic handling. These sample vessels are made of plastic which enhances their durability and flexibility in the automated handling processes. One example of the sample vessels designed for automatic operations is disclosed in publication WO 2012/056116.

SUMMARY OF THE INVENTION

Both FDA (US Food and Drug Administration) and MDD/IVD standard ISO 13485 require that patient results generated by in vitro diagnostic (IVD) instruments must be traceable back to the original patient samples and to all analytically critical components of the analyzer systems including liquid consumables and disposables used in the analyzing processes.

In the context of the present invention a microbiology laboratory has several rooms or laboratories for different kinds of sample types. These rooms are also categorized based on biosafety levels (BSL) of the biological agents handled to BSL-1, BSL-2, BSL-3, and BSL-4. Many hazardous microbes, such as mycobacteria for example, are processed in BSL-3 level laboratories and non-hazardous microbes are processed in BSL-1 level laboratories. Samples from these laboratory rooms are transferred to a separate analyzing room for analysis, which analyzing room is equipped with suitable analyzer instruments and serve several different laboratory rooms.

Generally, the samples to be analyzed are prepared in a sample preparation station located at the BSL room or rooms. The sample preparation station comprises an instrument to facilitate movement of primary samples (e.g. bacterial colony) from original sample media (e.g. agar plate, blood culture bottle) to a sample vessel in an ergonomic manner which further reduces errors.

As an example, a primary sample in an agar plate is taken to the sample preparation station and identification data of the primary sample, which is stored in a barcode, radio frequency identification (RFID) tag or other indicia, is read to the sample preparation station with a suitable reader. Once confirmation of the data input is received, for example by a visual or audio signal, a specimen sample is taken from the primary sample with a sampling device, and the primary sample is returned to its storage. Next a sample vessel is taken, and its identification data is read to the sample preparation station with a suitable reader as was done with the primary sample. Then the sample in the sampling tool is inserted in the sample vessel, and the end of the sampling tool containing the sample is detached inside the sample vessel by twisting the sample tool, for example. The remaining part of the sampling tool is discarded and the lid or cap of the sample vessel is closed. The sample vessel together with the sample is placed in an empty position of a sample vessel rack located in the sample preparation station in a proper orientation. The sample preparation station detects the location of the newly inserted sample vessel in the sample vessel rack and connects identification data obtained from the primary sample and the new sample vessel to the location of the sample vessel in the sample vessel rack.

When the sample vessel rack contains the required number of sample vessels, the sample vessel rack is removed from the sample vessel preparation station. In one example, the removal action also activates a locking means in the sample vessel rack. The locking means prevent the removal of any of the sample vessels located in the rack when locking is activated. The sample vessel rack is then inserted into an analyzing instrument, which insertion action optionally deactivates the locking means in the sample vessel rack, allowing removal of the sample vessels from the sample vessel rack for analysis operations.

The obtained analysis results are connected to the identification data of the sample from the sample preparation station, so that each analysis result can be tracked to a single sample.

The present invention provides a sample vessel, to be used for example in the above described process, that allows for easier and safer sample transfer to the sample vessel and safer and more secure handling and transfer of the sample vessel, including the automated handling of the vessel by an analyzer instrument. The present invention also provides a sample vessel that allows implementation of enhanced traceability through the whole analyzing process.

The sample vessel of the invention comprises an elongated vessel body for containing the sample and a hinged cap connected in top end area of the vessel body, wherein the cross-section of the vessel body on a transversal plane in relation to the lengthwise center axis of the vessel body the inner surface of the vessel body is rotationally asymmetrical in relation to the lengthwise center axis. The asymmetrical shape of the inner surface of the vessel body allows for easy and secure insertion of a sample in the sample vessel with a suitable tool by wedging the end of the tool against inner surfaces of the vessel body and by twisting or bending the tool and thus breaking the end portion of the tool together with the sample inside the vessel body. An example of this type of tool is disclosed in a patent application filed at the same date and by the same applicant as the present application.

The sample vessel of the invention also comprises a surface extending upwards from the vessel body, which surface partially surrounds the edge of the cap, when the cap is in a closed position. This surface prevents the sample material slashing from the sample vessel when the cap of the sample vessel is opened, for example. The upwards extending surface is preferably situated substantially in 90 degrees angle in relation to the plane of the top of the cap when the cap is in a closed position. The upwards extending surface also provides a gripping surface when the sample vessel is moved robotically in the automated handling of the sample vessel. This can be implemented with a robot gripper sleeve, which is pushed against the outer surface of the vessel's upwards extending surface, i.e. a collar, to such extent that friction between the surfaces keeps the vessel in grip, for example.

In an embodiment of the sample vessel of the invention the cross-section of the inner surface of the vessel body is substantially oval-shaped.

In an embodiment of the sample vessel of the invention the outer surface of the vessel body is tapered, which helps in setting the sample vessel in a sample vessel rack. Further, the oval shape of the cross-section of the inner surface of the vessel body preferably also extends to the outer surface of the vessel body, which enhances the proper orientation of the sample vessel when it is placed in a sample vessel rack, for example. This is very important in the automatic handling of the sample vessel, where the proper orientation of the sample vessel is critical for the operation of the analyzing instruments.

The oval shape of the sample vessel body allows the vessel to be inserted into e.g. sample rack in two different orientations, which are 180 degrees apart. In an embodiment of the sample vessel of the invention the outer surface of the vessel body is equipped with a protrusion. This protrusion is used for preventing the insertion of the sample vessel in the incorrect one of the two orientations in 180 degrees, preferably together with the form and shape of the outer surface of the vessel body, when placed in a sample vessel rack, so that the cap can be automatically opened, for example. The protrusion may also be used for securing the sample vessel at its place in a sample vessel rack, when the sample vessel rack is equipped with suitable locking means. An example of this kind of sample vessel rack is disclosed in a patent application filed at the same date and by the same applicant as the present application.

In an embodiment of the sample vessel of the invention the cap of the sample vessel comprises a tab extending from the upper surface of the cap, when the cap is in closed position. This tab may be used for automatic opening of the sample vessel with an analyzing instrument, for example. The tab is preferably formed substantially flat on its upper surface to allow controlled manual opening and closing of the cap without fear of tearing protective gloves and for providing comfortable and ergonomic contact surface against the user's finger. The tab is also preferably formed so that it allows the use of suitable opening tools to be used both in automatic and manual opening and closing of the cap. The controlled opening of the cap of the sample vessels is important in order to prevent liquid droplets possibly located on the inner surface of the cap from splashing outside the vessel during the opening process.

In an embodiment of the sample vessel of the invention the cap comprises a bracket extending from the lower surface of the cap, when the cap is in closed position, which bracket comprises a sealing protrusion on the side surface of the bracket at a distance from the lower surface of the cap. When the cap is in closed position the sealing protrusion sets itself against the inner surface of the sample vessel, and thus provides sealing effect for the closed cap. Advantageously the bracket is circular in form, preferably oval-shaped to correspond to the cross-sectional form of the inner surface of the sample vessel, so that the sealing protrusion in the outer surface of the bracket forms a ring.

In an embodiment of the sample vessel of the invention the outer side surface of the vessel body comprises a substantially level area. This level area may be used for printing a bar code on the level area, which allows for better traceability of the analyzing results and of the whole analyzing process.

In an embodiment of the sample vessel of the invention the vessel body comprises a substantially level bottom surface. This level horizontal bottom surface provides better contact with a flat tipped ultrasonic mixing probe and thus enhances the ultrasonic mixing process.

In an embodiment of the sample vessel of the invention the inner surface of the sample vessel comprises one or more protrusions, preferably at the bottom area of the sample vessel, which protrusion(s) for a narrow slot inside the sample vessel. This thus formed slot can be used as an additional support surface(s) for detaching a part of a suitable sample transferring tool, for example.

In an embodiment of the sample vessel of the invention the sample vessel is formed from suitable plastic material, such as PP (Polypropylene), with injection moulding. Further, in an embodiment of the sample vessel of the invention the sample vessel, especially the vessel body, is essentially rigid and does not allow deformation when squeezed manually. Preferably, the deformation of the sample vessel requires a force exceeding 60 Newtons.

The features defining a sample vessel of the invention are more precisely presented in claim 1. Dependent claims present advantageous features and embodiments of the invention.

DRAWINGS

Figure 1D:
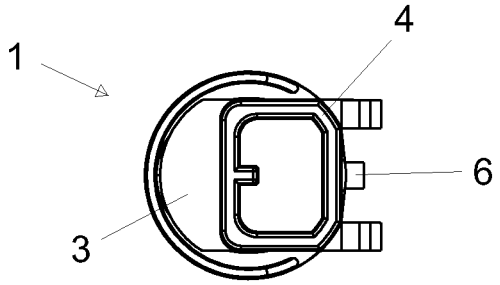
Figure 1B:
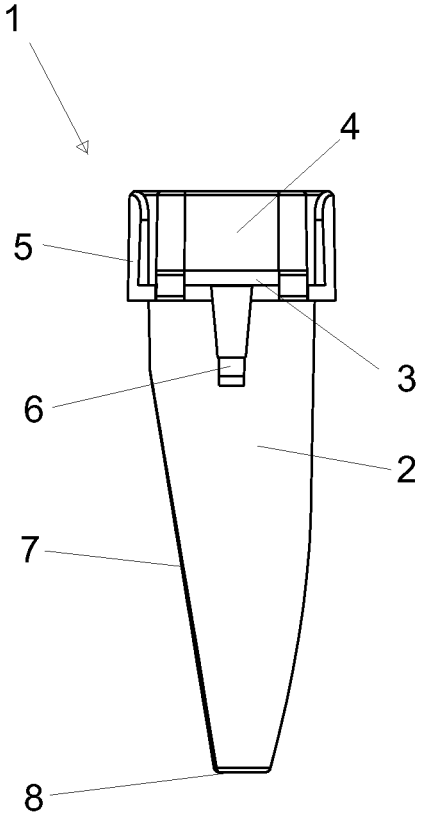
Figure 1C:
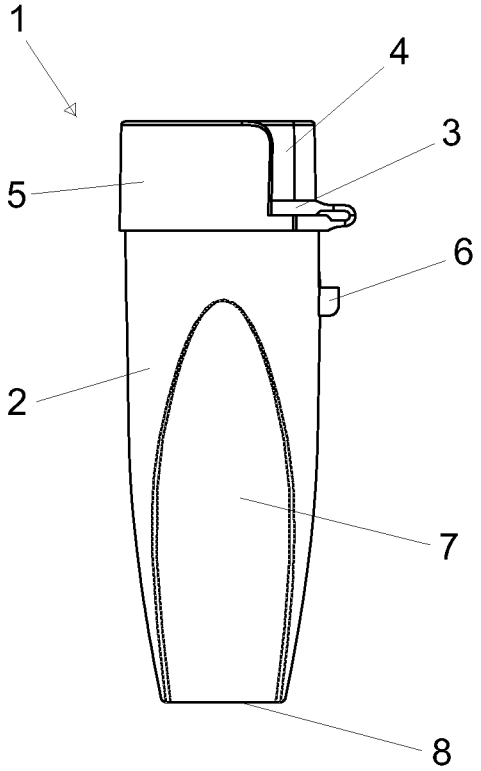
Figure 1E:
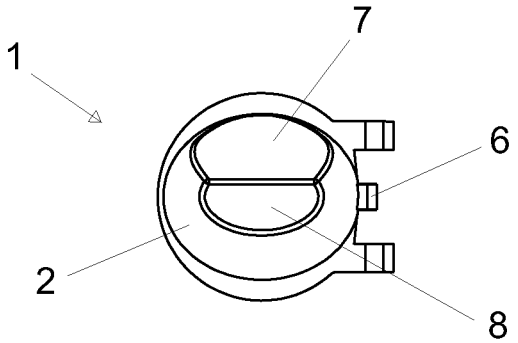

An exemplifying embodiment and its advantages are explained in greater detail below in the sense of an example and with reference to the accompanying figures, where FIG. 1A shows an embodiment of a sample vessel of the invention as a perspective view, FIG. 1B shows the embodiment of FIG. 1A as a back view, FIG. 1C shows the embodiment of FIG. 1A as a side view, FIG. 1D shows the embodiment of FIG. 1A as a top view, FIG. 1E shows the embodiment of FIG. 1A as a bottom view, and FIGS. 2A-2D shows an alternative embodiment of a sample vessel of the invention.

DETAILED DESCRIPTION OF THE EMBODIMENT

In the figures is shown a sample vessel 1, which comprises an elongated vessel body 2 and a cap 3 attached to the upper end of the vessel body with integral hinges. From top surface of the cap 3 extends a tab 4. The outer edge of the cap 3 is partially surrounded with a splash guard 5 connected to the upper end of the vessel body 2.

The elongated vessel body 2 has in this embodiment, as can be best seen from FIG. 1E, an oval cross-section, both for the outer and inner surface of the vessel body. The oval cross-section of the inner surface of the vessel body 2 allows the end of a suitable sample collecting tool to be wedged between inner surfaces of the vessel body 2, so that the end of the sample collecting tool can be broken off by twisting or turning the sample collecting tool, and the end of the sample collecting tool is left together with the sample inside the vessel body. This guarantees the proper sample transfer to the sample vessel 1 for further analysis. The oval cross-section of the outer surface of the vessel body 2 also enhances the usability of the sample vessel 1 in automated and robotic handling of the sample vessel.

The elongated vessel body 2 is in this embodiment also formed to have tapered shaped, as can be best seen from FIGS. 1B and 1C. This tapered shape helps the setting of the sample vessel 1 in a sample vessel rack, for example.

In the outer surface of the vessel body 2 is formed a protrusion 6, which operates as a guiding and locking tab when the sample vessel 1 is inserted in a correspondingly formed slot of a sample vessel rack. During insertion of the sample vessel 1 to the sample vessel rack, the protrusion 6 requires that the sample vessel is in proper orientation in relation to the sample vessel rack, otherwise the sample vessel may not be inserted properly in the rack. In obtaining the proper orientation for sample vessel 1 when the sample vessel is inserted in a sample vessel rack, the oval cross-section of the outer surface of the vessel body 2 advantageously works together with the protrusion 6 and helps to guide the sample vessel into correct orientation. The upper edge of the protrusion 6 also allows a suitable locking means, which locking means are preferably part of the sample vessel rack, to be set on top of the protrusion. This prevents the removal and changing of place of the sample vessel 1 once it is placed on the sample vessel rack and locked there.

On the outer surface of the vessel body 2 is formed a substantially level area 7. This level area 7 allows suitable identification means, such as bar codes or color codes to be printed or otherwise easily added to the sample vessel 1. The level area 7 also identifies the area from where the suitable identification information can be found on the sample vessel 1.

The bottom surface 8 of the vessel body 2 is formed substantially level in horizontal direction. This flat bottom surface 8 allows for better contact with a flat tipped ultrasonic mixing probe, and thus enhances the ultrasonic mixing effect.

The top part of the sample vessel 1 comprises the splash guard 5, which extends upwards from the top end of the vessel body 2, and partially around the side surface of the cap 3. The splash guard 5 defines surface that prevents possible sample droplets in the interior of the cap 3 or on the inner surface of the opening of the vessel body 2 to get airborne and contaminating the surroundings when the cap is opened.

From the upper or outer surface of the cap 3 extends upwards the tab 4, which enables both the manual and automatic opening and closing of the cap. The tab 4 is formed to cover, or more precisely encircle in this embodiment, a significant area, over half as can be best seen from FIG. 1D, of the upper surface of the cap in order to provide suitably large contact area also for a controlled manual opening and closing of the cap.

Figure 2C:
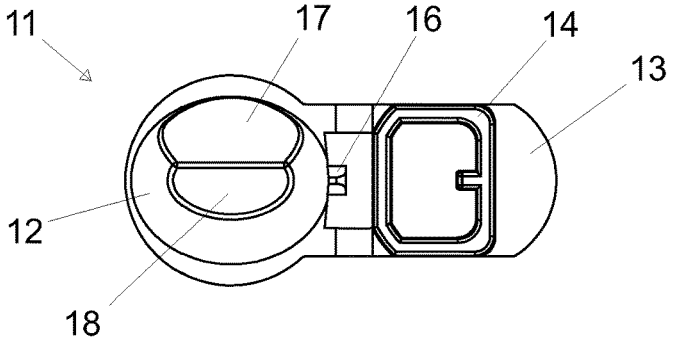
Figure 2A:
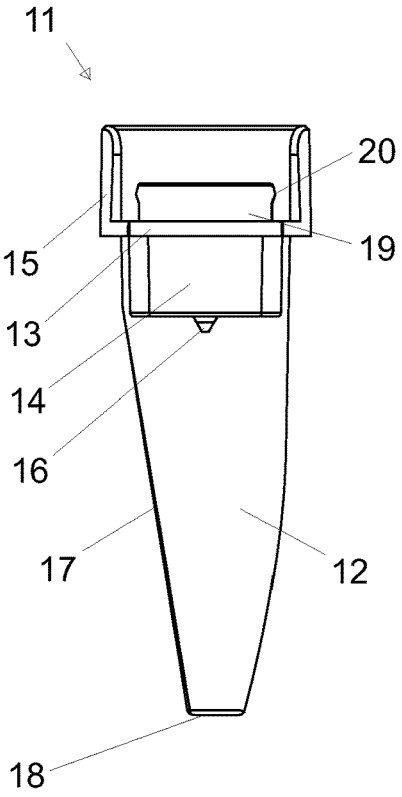
Figure 2B:
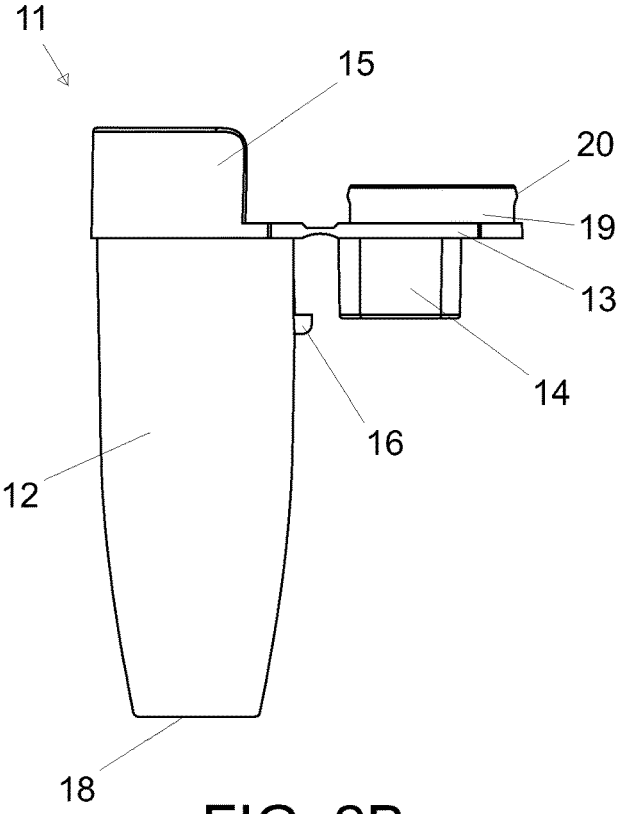
Figure 2D:
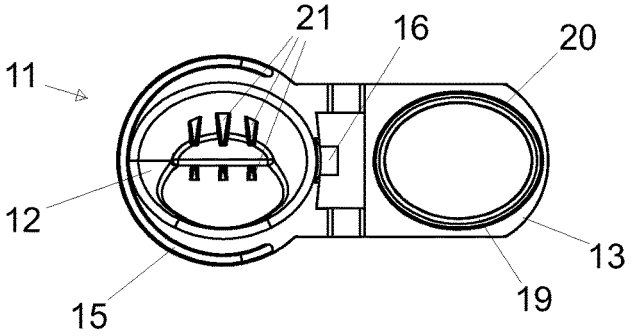

FIGS. 2A-2D shows an alternative embodiment of a sample vessel of the invention, where FIG. 2A is a back view of the sample vessel, FIG. 2B is a side view of the sample vessel, FIG. 2C is a bottom view of the sample vessel, and FIG. 3D is a top view of the sample vessel. In the figures the sample vessel 11 is shown the cap 13 in open position.

In the embodiment of FIGS. 2A-2D, the vessel body 12, the tab 14, the splash guard 15, the substantially level area 17, and the flat bottom surface 18 are the same than in the embodiment of FIGS. 1A-1E.

In the embodiment of FIGS. 2A-2D, the protrusion 16 has been made a little smaller, and formed substantially V-shaped. This shape of the protrusion 16 allows for better and more robust guidance for the sample vessel 11 to a proper orientation when the sample vessel is inserted in an opening with a slot for the protrusion.

The cap 13 comprises a bracket 19, which extends downwards from the lower surface of the, when the cap is in closed position. At the lower edge area of the bracket 19, at the side surface of the bracket, there is formed a sealing protrusion 20. The sealing protrusion 20 enhances the sealing effect of the side surface of the bracket 19, which side surface sets itself against the inner surface of the body 12 of the sample vessel 11. As can be best seen from FIG. 2D, the shape of the bracket 19 is substantially oval-shaped to correspond to the cross-sectional shape of the inner surface of the body 12 of the sample vessel 11, and the sealing protrusion 20 extends around the outer surface of the bracket 19 to form a sealing ring.

At the bottom portion of the inside of the body 12 of the sample vessel 11 there are formed a plurality of protrusions 21 extending from the inner bottom and side surfaces of the vessel body, which protrusions form a slot at the bottom of the sample vessel. This slot is suitable for receiving a detachable portion of a suitable sample transfer tool, and provides support for detaching the detachable portion of the tool together with the sample inside the sample vessel.

In the present invention the tab 6 and 16 of the above discussed embodiments may be also be implemented with different shapes, sizes and locations, depending on the requirements for different implementations, for example. The key function of the tab, however, remains the same, i.e. guiding the sample vessel in a proper orientation in a sample vessel rack, and/or preventing inserting of the sample vessel in a sample vessel rack in an improper orientation, and/or utilizing locking of the sample vessel in a sample vessel rack.

The specific exemplifying embodiments of the invention shown in figures and discussed above should not be construed as limiting. A person skilled in the art can amend and modify the embodiments in many evident ways within the scope of the attached claims. Thus the invention is not limited merely to the embodiments described above.

We claim:

1. A sample vessel comprising:

a vessel body;

a cap;

a tab; and a splash guard;

the vessel body having a compartment that extends between a first end and an opposing second end, the compartment being configured to hold a liquid sample, the vessel body comprising a sidewall encircling the compartment and having an interior surface extending between the first end and the opposing second end of the vessel body;

a floor connected to the sidewall at the second end of the vessel body and having an interior surface, the compartment having a central longitudinal axis passing through the compartment between the first end and the second end of the vessel body having a transverse cross-section that is rotationally asymmetrical in relation to the central longitudinal axis;

the cap having a width, a length, a bottom surface, a top surface, an edge and a circular raised rim extending from the bottom surface, the circular raised rim having an internal surface and an external surface, the external surface of the raised rim having a diameter equal to or less than the diameter of the interior surface of the first end of the vessel body, the cap being attached to the vessel body by a hinge at the edge of the length of the cap;

the tab extending from the top surface of the cap, the tab being of square or rectangular shape; and the splash guard being attached to first end of the vessel body and extending away from the opposing second end of the vessel, the splash guard forming a raised semi-circle, the semi-circle being uninterrupted opposite of the hinge, with the splash guard having an external and an internal face, the diameter of the internal face of the splash guard being greater than the width of the cap.

2. The sample vessel according to claim 1, wherein the cross-section of the inner surface of the vessel body is substantially oval shaped.

3. The sample vessel according to claim 1, wherein an outer surface of the vessel body is tapered.

4. The sample vessel according to claim 3, wherein the outer surface of the vessel body is equipped with a protrusion for guiding the sample vessel in correct position when placed in a sample vessel rack and/or securing the sample vessel at its place in a sample vessel rack.

5. The sample vessel according to claim 3, wherein the second end of the vessel body is a substantially level surface.

6. The sample vessel according to claim 1, wherein the inner surface of the sample vessel comprises at least one protrusion for forming a narrow slot inside the sample vessel.

* * * * *